United States Patent [19]

Ibarguengoitia

[11] 4,065,365

[45] Dec. 27, 1977

[54] METHOD FOR IMPROVING FRICTIONAL SURFACE IN CYLINDERS OR SLEEVES OF INTERNAL COMBUSTION ENGINES

[75] Inventor: Juan Retolaza Ibarguengoitia, Bilbao, Spain

[73] Assignee: Aplicaciones Industriales de Cromo Duro, S.A., Bilbao, Spain

[21] Appl. No.: 755,602

[22] Filed: Dec. 29, 1976

Related U.S. Application Data

[63] Continuation-in-part of Ser. No. 559,649, March 18, 1975, abandoned.

[51] Int. Cl.[2] ..... C25D 7/04; C25D 5/36; C25D 5/50; C25D 5/52

[52] U.S. Cl. ..... 204/25; 204/29; 204/35 R; 204/36; 204/37 R; 51/323

[58] Field of Search ..... 204/25, 29, 35 R, 36, 204/37 R; 51/323

[56] References Cited

U.S. PATENT DOCUMENTS

| | | | |
|---|---|---|---|
| 2,430,750 | 11/1947 | Webersinn | 204/35 R |
| 2,450,296 | 9/1948 | Passalacqua | 204/37 R |

*Primary Examiner*— G. L. Kaplan
*Assistant Examiner*—William T. Leader
*Attorney, Agent, or Firm*—Wenderoth, Lind & Ponack

[57] ABSTRACT

Method of preparing chromium plated surfaces of improved anti-friction property, by machining the base material to a smooth finish, chromium plating the machined surface of the base material, heating the chromium plated surface at 150°-325° C for 1-3 hours, cooling and honing the surface, and lapping the surface with an abrasive to a surface finish such that the roughness of the surface measures 25-50 micro-inches center line average.

10 Claims, 9 Drawing Figures

METHOD FOR IMPROVING FRICTIONAL SURFACE IN CYLINDERS OR SLEEVES OF INTERNAL COMBUSTION ENGINES

This application is a continuation-in-part of Ser. No. 559,649, filed Mar. 18, 1975, now abandoned.

This invention relates to a new method for obtaining chromed surfaces with good anti-frictional properties. More particularly it relates to a method for improving the sliding surface of a chromium coating on a sleeve or cylinder, for example those used in reciprocating or rotary internal combustion engines, on which surface a piston, rotor or the like is slidable. The improvement gives a more rapid bedding-in of the said components during the running-in period and a greater endurance during service.

It is known that cylinders and engine sleeves which have a chromed surface have an improved resistance to wear and corrosion. It is also known that a smooth hard chromium plating per se does not provide a sliding surface most suitable for this purpose because of difficulty in its retaining lubricants. For this reason various kinds of chromium plated surfaces have been developed which have grooves, channels, pockets or pores in which the lubricant can be retained.

Chromed surfaces of this nature can be obtained by various known processes, consisting of etching the chromium coating by chemical or electrochemical methods, or by treating the iron or steel base material before chromium plating by scoring or engraving it, using mechanical means, as described in British Pat. Nos. 583,872 and 992,743.

Both processes have their disadvantages when being used in mass production. In the method of etching the chromium coating after plating by chemical and/or electrochemical methods, control is difficult during the operation, since the amount of etching depends not only on the conditions under which these methods are carried out, but also on the conditions of the chromium plating. In the case of the methods consisting of treating the base material before chromium plating by mechanical means, which may involve grooving the base material by turning it in a lathe, marking by knurling, sand blasting or scratching by lapping with loose abrasive grit or the like, the final surface, following chromium plating, exhibits the irregularities created by the grooving, knurling, sand blasting or scratching. The sleeve or cylinder must, after the chromium plating operation, be geometrically correct with the exact final dimensions required by the finished product, since any additional mechanical operation after the chromium plating will partially or completely remove the pattern previously formed on the surface. More particularly, when a small thickness, say below 0.002 inch, of chromium is plated onto a surface the plating follows very closely the contours of the original surface. If a particular surface is required after plating, this particular surface is prepared on the original surface so that by plating to the correct tolerance in thickness, the desired surface will be obtained. However, if the plating is not to the correct thickness and a mechanical machining operation has to be carried out, the finished surface, to the correct tolerance, will not look or be correct.

Another disadvantage of these processes is that the quality of surface finish of the chromium coating is very much dependent on the conditions of the chromium plating itself, which in general cannot remain ideal during production runs, and therefore it is not always possible to obtain the best conditions necessary for the initial running-in and the rapid bedding-in of the piston and sleeve.

It is appreciated that the method of lapping with loose abrasive grit on the iron or steel base material should result in a chromium plated surface which has a suitable quality of surface finish and may avoid the problems set out in the previous paragraph, but in practice it does not succeed in this way. For example, by lapping a surface of iron or steel base material using an abrasive having a base of powdered silicon carbide of grain size 220 suspended in a mineral oil, and using an expanding mandrel in which the laps are of cast iron and operate by pressing against the walls of the cylinder, there results a lapped surface scored with scratches that cross one another, whose roughness, measured by the "Center line average" or "Arithmetic average" method rates between 45 and 75 micro-inches. This surface, after chromium plating, will read between 45 and 85 micro-inches, and this range is too wide. To achieve a smaller range is difficult in mass production because the abrasive grit breaks during use.

Another important point is that for a good antifrictional and sliding surface it is not only necessary to take into account the surface finish itself, but it is also necessary to take into account the actual bearing surface, that is to say the portion of the surface which stands out in the form of peaks with respect to the complete surface formed by peaks and valleys. In the methods considered above, it is practically impossible to control the bearing surface between the limits which are necessary in the motor industry today.

It is the object of this invention to provide mass production methods for producing a chromium plated surface with a smaller range of CLA (Center Line Average) readings than those which have previously been mentioned, and which also gives the required bearing surface.

It is another object of the present invention to provide a method of producing a chromium plated antifriction surface having the required thickness on a cylinder or sleeve for use in an internal combustion engine.

These objects are achieved by a method which comprises machining (by fine turning or grinding) the base material to a smooth finish of up to 10 micro-inches CLA, chromium plating the machined surface and then heat treating the chromium plated surface at a temperature between 150° and 325° C for 1 to 3 hours, cooling the chromium plated surface in air to room temperature, honing the cooled surface (e.g. by conventional honing machines using abrasive stones) to remove any irregularities from the chromium plating, and lapping or blasting the honed surface by conventional methods with abrasive grit (e.g. silicon carbide or aluminum oxide) to result in a specified surface finish between the limits of 25 and 50 micro-inches CLA. This method is equally applicable whether the base material is iron, steel, aluminum, copper or any other metal.

The present invention can be more easily understood by reference to the drawings, wherein.

Figure 1:
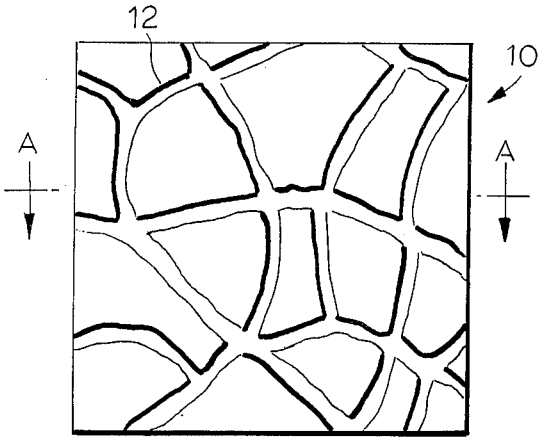
FIG. 1 is an enlarged view of a chromium coated surface.
Figure 3:
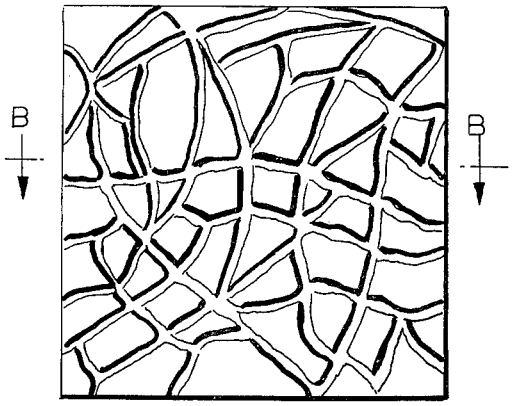
FIGS. 2–4 are variations of the surface of FIG. 1, resulting from heat-treating the surface of FIG. 1 under varying conditions.
Figure 7:
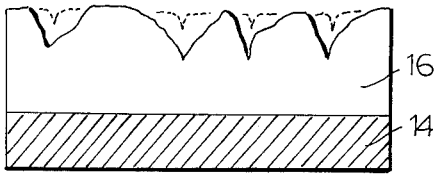
Figure 8:
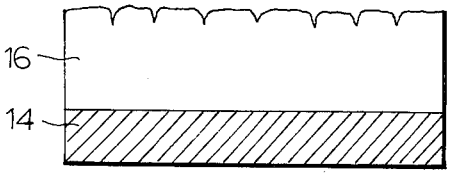

FIG. 7 discloses the variation in rugosity of the surface of FIG. 1 before and after lapping; and FIG. 8 is a cross-sectional view of FIG. 3 along B—B after the surface of FIG. 3 has been lapped.

Figure 9:
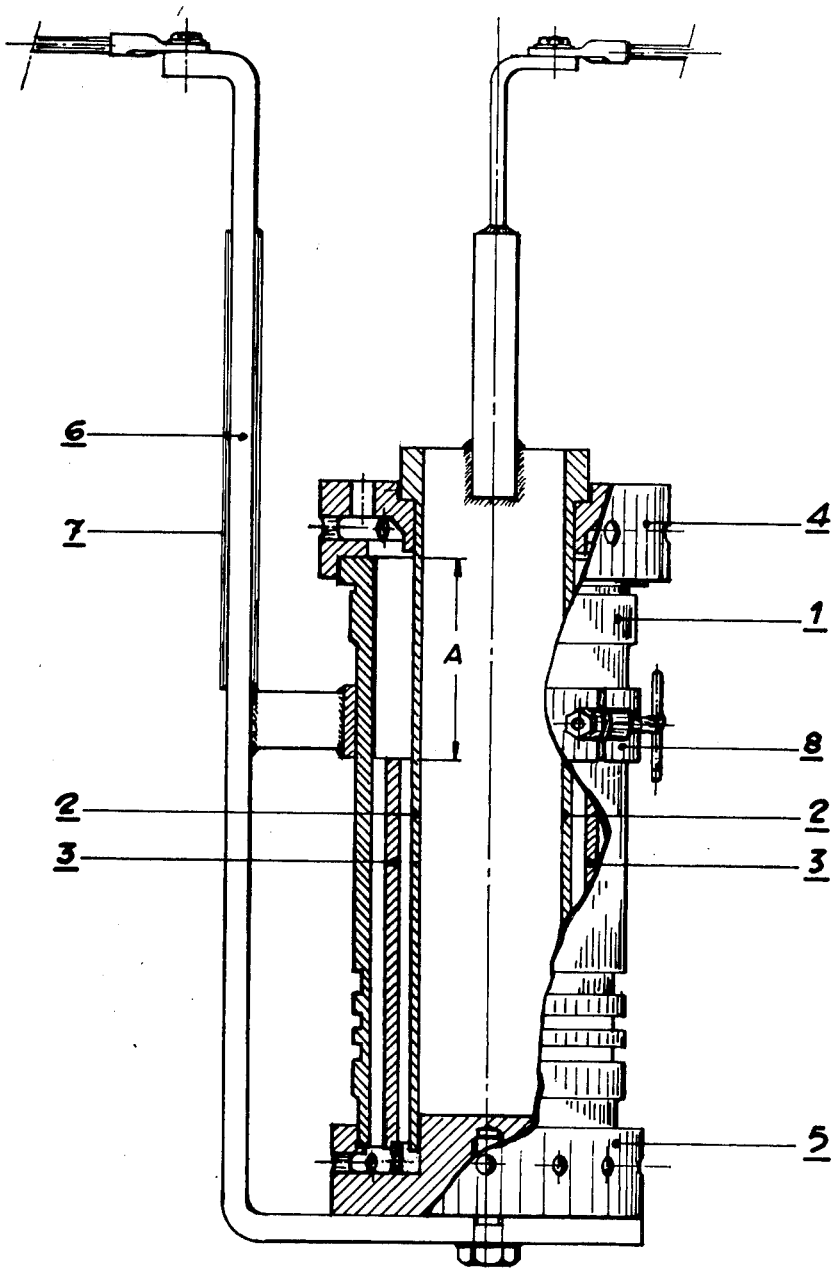

FIG. 9 shows an apparatus for electrochemically attacking selected areas of a chromed surface to increase the porosity of those areas.

It is known that the surface of a coating of hard chromium is covered with a network of microfissures. The action of lapping with abrasive grit is that the grit works on the sharp edges of the microfissures by fragmenting and tearing. The continuous action of lapping gives a final surface finish which is microscopically rough and irregular.

If the network of microfissures is open, as illustrated in FIG. 1 of the accompanying drawings, wherein 10 is a chromium plated surface obtained by a standard plating process (which has then been subjected to a weak acid etch for the purpose of allowing the microfissures to be seen more clearly upon microscopic examination), and 12 is the network of microfissures, the action of the abrasive will be more violent than if the network is closed, as illustrated in FIG. 3. In this way the final roughness of the lapped chromed surface will depend on the size of the network of microfissures and not on the grain size of the abrasive. Consequently, to obtain a certain roughness it is necessary to control the size of the network of microfissures.

The nature of the network of microfissures fundamentally depends on the conditions of the chromium plating process, but also can be modified or altered by thermal treatment as described in British Pat. No. 601,065. The chromium plated surfaces which are to be subjected to treatment in accordance with the present invention can be obtained by following the plating process (and, optionally, thermal treatment) described in this British Patent.

Figure 5:
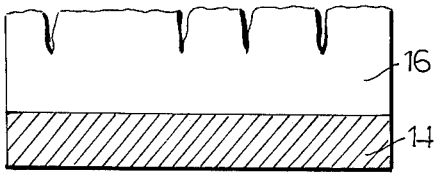
FIG. 5 is a cross-sectional view of FIG. 1 taken along the line A—A.

A chromium plated surface produced under known conditions will have a network of microfissures similar to that shown in FIG. 1, when viewed at a magnification of 270 times, after it has been subjected to a weak acid etch to facilitate microscopic examination as indicated above. FIG. 5, wherein 14 is the base material, e.g. iron or steel, and 16 is the chromium coating, shows a section viewed at A—A in FIG. 1. This same section is shown in FIG. 7 by the dotted line, and the continuous line in FIG. 7 shows the effect after lapping with abrasive grit.

FIG. 3 shows the same chromium plated surface as FIG. 1 but after modification by heat treatment at a temperature of 250° C for 2 hours, and the microfissures now appear thinner and more numerous.

Figure 6:
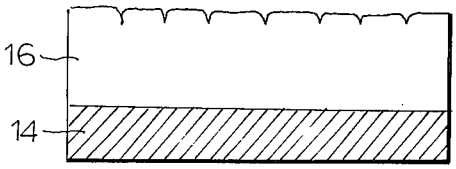
FIG. 6 is a cross-sectional view of FIG. 3 taken along line B—B.

In FIG. 6, there is shown a cross section at B—B of FIG. 3, and FIG. 8 shows the same cross section after lapping with abrasive grit.

Figure 2:
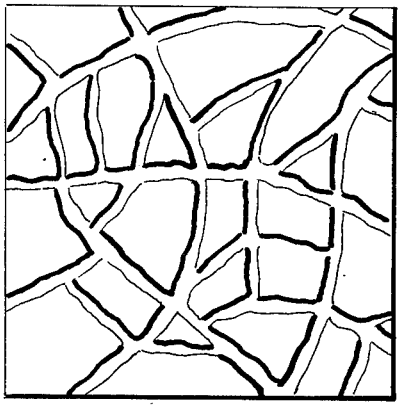
Figure 4:
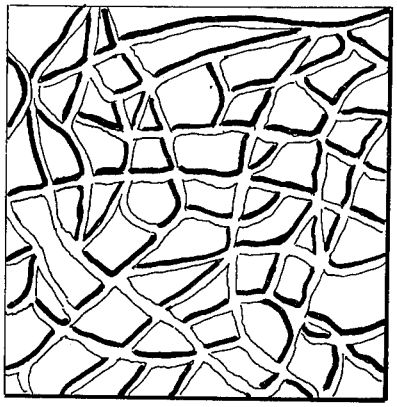

FIG. 2 shows the same chromium plated surface as in FIG. 1 but after it has been subjected to heat treatment at 150° C for 2 hours. FIG. 4 shows the same chromium plated surface as in FIG. 1 after heat treatment at a temperature of 325° C for 2 hours.

The invention is also concerned with controlled variations in the chromium coating after the blasting or lapping with abrasive grit.

A chromium surface obtained and treated similarly to that previously described can offer an adequate superficial surface but not the most convenient bearing surface, since the profile of the coating can be extremely aggressive, i.e. abrasive, and give rise to undesirable premature wear. To overcome this, a final mechanical operation of smoothing out the peaks is carried out using an expanding madrel, in which the parts of the mandrel that come into contact with the chromium surface are under pressure of 10–60 p.s.i. and are interspaced with a very fine abrasive mixed with an elastic carrier, such as CRATEX (Registered Trademark) rubberized abrasives. The mandrel is rotated at 30–100 r.p.m. and reciprocated at 40–60 strokes per minute at the same time with a stroke length equal to the length of the workpiece or shorter, using as lubricant a paraffinic oil with phosphor and chlorine based additives. An example of such a lubricant is FRAPOL C.P. from Houghton Co., USA, which has a viscosity of 1.3–1.5 degrees E. and a flash point of approximately 120° C. This operation of smoothing off the peaks means removing fractions of a thousandth of a millimeter which of course does not represent any appreciable change in the size of the finished component but improves the bearing area and surface, i.e. polishes the surface, without modifying the structure of the porous chromium plating perviously achieved.

By this method, the surface of a cylinder or sleeve for any internal combustion engine which is subject to contact or rubbing by a piston or the like will acquire a high resistance to wear and at the same time, acquire the necessary lubrication retention properties in the porous surface. The superficial roughness of the chromium surface can be varied and controlled, as can the proportion of the pores (valleys) and the smooth surface (peaks), as its use requires. The cylinders and sleeves obtained in accordance with the method of the present invention are suitable for application to any internal combustion engine, both reciprocating and rotary, independent of the nature of the base material of the sleeve or cylinder, as long as it can be chromium plated.

In certain cases in the application of chromium plating on sleeves or cylinders, there is required a greater degree of porosity in certain areas only, for the purpose of achieving more intensified lubrication in those areas. An example of this is the case of a supercharged four-stroke engine in which, as a consequence of the severe working conditions with high pressures, temperatures etc., it is difficult to obtain the correct lubrication of the upper part of the cylinder. A similar difficulty is experienced in a two-stroke engine but this area also extends around the exhaust ports. In these cases it is necessary to use a means of obtaining the correct lubrication pattern in these areas.

Increasing the porosity in the whole of the cylinder or sleeve to give the correct lubrication pattern in the areas mentioned above, would at the same time increase the consumption of lubricant to an unacceptable level overall and consequently create other problems and disadvantages. In fact it is necessary to increase the lubrication pattern only in the required areas, that is to say, produce an increase in the porosity level only in the required areas, maintaining the remainder with a reduced porosity level.

In such a cylinder, sleeve or rotor housing that requires this differing grade of porosity it is essential that the transition from one grade to another be gradual and not sudden. Therefore the increase in the porosity should be progressive. Nevertheless, it will be necessary to operate on the newtork of microfissures in such a way as to produce two or more different networks in the same component.

To achieve this condition it is not practical to control the conditions of the plating, neither is it easy to control the thermal treatment in separate areas on one component. Therefore neither of these two variations offers the answer to this problem.

It has been proved that a practical solution can be obtained by a chemical or electrochemical attack, or a combination of both, on the area in which it is required to have a greater degree of porosity. Carrying out this operation prior to the lapping with abrasive grit produces a deepening of the channels of the network of microfissures. This operation can be controlled perfectly by limiting it to the chosen area, and its effect is to attack the treated area to the extent of the limits of said area, without going out of the area, resulting in a component with different networks of microfissures. In this condition, the grit lapping or blasting will produce areas of different roughness and porosity. There are many methds of attacking the selected areas. One such method involves the use of dilute hydrochloric acid, for example in concentrations of 10–30%. The component is dipped into the acid for a period of one-half to 3 minutes depending upon the amount of attack required. Another method is electrochemical, by attacking the selected areas cathodically or anodically, using an electrolytic acid solution such as oxalic acid, sulphuric acid or chromic acid, or an electrolytic alkaline solution such as hydroxides, in concentrations of 10–30%.

For example, the operation can be performed using the same apparatus as that used for the chromium plating, except that what was then cathode is now the anode.

Referring to FIG. 9, there is shown a central lead electrode 2 — which is the anode for plating and the cathode for etching — positioned at top and bottom by plastic material supports 4 and 5 respectively. Surrounding the electrode 2 is the cylinder liner 1 which is secured by means of a clamp 8 to an electrode in the form of a steel rack 6 which is also attached to the bottom support 5. The rack 6 has a plastic material protection sleeve 7 to prevent it from being plated. The lower part of the electrode 2, for etching operations only, is surounded by a detachable plastic material (for example, polyvinyl chloride) tube 3 so that only the portion A of the cathode above the tube 3 will be active when the assembly is submitted to anodic attack, in this (etching) case with a current intensity of 10 to 15 amperes per sq. cm for 1 to 15 minutes. It is to be understood that the length of the plastic material tube 3 will depend upon the area of different porosity required on the cylinder line 1.

Lapping is done by using a conventional lapping machine with the laps rotating and reciprocating at the same time. The lapping medium is silicon carbide 180–220 grit size held in suspension in a liquid medium consisting of a fatty/mineral oil blend having a Redwood viscosity of 425–500 seconds at 20° C and an acid value of approximately 0.1. The proportions are 18 kg. of silicon carbide to 12 liters of the liquid medium.

The following working examples represent further detailed explanation of the invention, without limiting the invention thereto.

EXAMPLE 1

Cylinder liners used in a particular engine must be produced with an oil retentive bore of hard chrome and a finished internal diameter of 4.000 to 4.001 inches with a constant surface finish reading of 25 to 50 micro-inches CLA. The method of producing this bore is as follows:

1. The bore is first internally ground on an internal grinder of a suitable size such as can be seen in any machine shop that carries out this type of work. The grinding wheel is of 280 grit size aluminum oxide, to give a surface finish of 10 micro-inches CLA maximum, at an internal diameter of 4.004 to 4.005 inches 2. The bore is then hard chromium plated to comply with U.S. Federal specification QQ-C-320A, to an internal diameter of 4.000 to 4.001 inches .

3. To adjust the depth of the microfissures in the chromium plating, the liner is placed in an oven and brought up to a temperature of 250° C where it remains for a period of 2 hours. The liner is then removed from the oven and allowed to cool in air down to room temperature.

4. The next operation is honing to remove any irregularities on the surface of the chromium. This is done on any conventional honing machine of a suitable size which can be fitted with an expanding mandrel. This expanding mandrel is of the taper cone type where the centre main shaft is tapered and operated by oil pressure. The tapered centre shaft is moved in a vertical direction and moves against the backs of the honing stone holders. As the two tapers, the centre shaft and the backs of the honing stone holders, are the same, the honing stones move out in a radical direction until contacting the liner bore. The honing stones used for this operation are of 240 grit size silicon carbide, operated with a pressure of 50 p.s.i. The mandrel is rotated at 70 r.p.m. and reciprocated at 50 strokes per minute.

5. Blasting of the bore is then carried out on a blasting machine manufactured by A.I. Crome Duro, S.A. of Bilbao, Spain, in which the grit, 180 to 220 grit size silicon carbide, is fed into a pressurised air stream and directed at the liner bore. At the same time, the liner is revolving at a speed of 100 r.p.m. and the time of this operation is 30 seconds. This blasting operation can be substituted by a lapping operation, where 180 to 220 silicon carbide grit is suspended in a fatty/mineral oil blend having a Redwood viscosity of 425 to 500 seconds at 20° C and an acid value of 0.1. Here, the laps, usually made from cast iron, are pressed against the liner bore with a constant spring pressure of 20 p.s.i. and the lapping medium allowed to circulate freely through the bore for a period of 2 minutes.

6. Finally, the bore of the liner is polished to remove the microscopic peaks of the hard chromium on a conventional type honing machine, similar to that described in step 4 above, but instead of using the 240 grit size stones, the machine is fitted with CRATEX rubber bonded abrasive honing sticks. A constant 50 p.s.i. pressure is applied and the mandrel is rotated at 50 r.p.m. and reciprocated at 50 strokes per minute for a period of 25 seconds.

EXAMPLE 2

Where a cylinder liner requires progressive porosity in the bore, an addition operation is carried out. This involves the use of the equipment as shown in FIG. 9, and this operation is carried out between steps 4 and 5 in Example 1. The liner is assembled in the jig as shown in FIG. 9 and the plastic tube positioned as required, so that the only portion of the bore surface which can be attacked is the portion that requires a porosity different from that of the remainder of the liner bore. Instead of the central lead portion being used as an anode, as in the plating operation, the current is reversed and this lead portion then becomes the cathode. In this instance, the electrolyte is a 20% concentration of chromic acid in water. A current intensity of 10 amperes per square centimeter is applied for 12 minutes.

EXAMPLE 3

Instead of carrying out the additional operation of Example 2 to achieve progressive porosity in the bore, the portion of the liner for which increased porosity is desired can be immersed in a 20% aqueous solution of hydrochloric acid for 2 minutes. This operation is carried out between steps 4 and 5 of Example 1, after which the liner is washed with water to remove the acid.

I claim:

1. A method for preparing a chromium plated surface which comprises machining a metal base material to a smooth finish of up to 10 micro-inches CLA, chromium plating the machined surface, heat treating the chromium plated surface at a temperature between 150° and 325° C for 1 to 3 hours, cooling the heated surface in air, honing the cooled surface to remove irregularities from said surface, and lapping or blasting the honed surface with abrasive grit to obtain a surface finish between 25 and 50 micro-inches CLA.

2. A method according to claim 1, wherein the chromium plated surface is a chromium plated cylinder or sleeve suitable for use in an internal combustion engine.

3. A method according to claim 2, further comprising mechanically treating the lapped or blasted surface with an abrasive to polish said surface.

4. A method according to claim 3, wherein the mechanical treatment is carried out by means of an expanding mandrel in which the parts of the mandrel that come into contact with the lapped or blasted surface are interspaced with an abrasive mixed with an elastic carrier, the lapped or blasted surface is lubricated during said mechanical treatment, and the mandrel is simultaneously rotated about its axis and subjectd to a reciprocating movement.

5. A method according to claim 4, wherein the parts of the mandrel that come into contact with the lapped or blasted surface are under a pressure of 10 to 60 p.s.i., the rotation of the mandrel is at a rate of 30 to 100 r.p.m. and the reciprocating movement of the mandrel is at a rate of 40 to 60 strokes per minute.

6. A method according to claim 2, further comprising chemically treating a portion of the honed surface, prior to lapping or blasting, with hydrochloric acid having a concentration of 10 to 30%, thus providing said treated portion with a greater porosity than the untreated portion after carrying out the lapping or blasting.

7. A method according to claim 2, further comprising electrochemically treating a portion of the honed surface, prior to lapping or blasting, by subjecting said portion to cathodic or anodic attack in an electrolyte selected from the group consisting of oxalic acid, sulfuric acid, chromic acid and an alkaline hydroxide, the concentration of said electrolyte being 10 to 30%, thus providing said treated portion with a greater porosity than the untreated portion after carrying out lapping or blasting.

8. A method according to claim 7, wherein the electrochemical treatment is carried out at a current intensity of 10 to 15 amperes per sq. cm. for 1 to 15 minutes.

9. A method according to claim 2, wherein the abrasive grit is silicon carbide or aluminum oxide.

10. A method according to claim 1, wherein the metal base material is iron, steel, aluminum or copper.

* * * * *